US007028378B2

(12) United States Patent
Cheppe et al.

(10) Patent No.: US 7,028,378 B2
(45) Date of Patent: Apr. 18, 2006

(54) METHOD OF SHOT BLASTING AND A MACHINE FOR IMPLEMENTING SUCH A METHOD

(75) Inventors: Patrick Cheppe, Basse-Goulaine (FR); Jean-Michel Duchazeaubeneix, Les Sorinieres (FR)

(73) Assignee: Sonats-Societe des Nouvelles Applications des Techniques de Surfaces, Reze (FR)

( * ) Notice: Subject to any disclaimer, the term of this patent is extended or adjusted under 35 U.S.C. 154(b) by 306 days.

(21) Appl. No.: 09/972,863

(22) Filed: Oct. 10, 2001

(65) Prior Publication Data

US 2002/0042978 A1 Apr. 18, 2002

Related U.S. Application Data

(60) Provisional application No. 60/246,095, filed on Nov. 7, 2000.

(30) Foreign Application Priority Data

Oct. 12, 2000 (FR) ..... 00 13064

(51) Int. Cl.
*B21C 37/30* (2006.01)
*B21K 25/00* (2006.01)

(52) U.S. Cl. ..... 29/90.7; 29/889.21

(58) Field of Classification Search ..... 29/90.7, 29/889, 889.21, 90.01, 81.09, 81.01, 821, 29/743; 72/53

See application file for complete search history.

(56) References Cited

U.S. PATENT DOCUMENTS

| | | | | |
|---|---|---|---|---|
| 2,494,733 A | | 1/1950 | Whitehead | |
| 2,796,702 A | | 6/1957 | Bodine, Jr. | |
| 3,464,163 A | | 9/1969 | Ferrara | |
| 4,122,603 A | | 10/1978 | Sastri | |
| 4,313,995 A | * | 2/1982 | Delgadillo | 428/201 |
| 4,426,867 A | | 1/1984 | Neal et al. | |
| 4,432,220 A | * | 2/1984 | Loersch et al. | 72/53 |
| 5,509,286 A | | 4/1996 | Coulon | |

(Continued)

FOREIGN PATENT DOCUMENTS

EP 0 492 323 7/1992

(Continued)

*Primary Examiner*—John C. Hong
(74) *Attorney, Agent, or Firm*—Oliff & Berridge, PLC

(57) ABSTRACT

A part to be shot peened includes at least one thin wall (12") defining two opposite main faces, the square root of the area of each face being greater than the mean distance between the two faces by a factor of at least five, and preferably by a factor of at least ten. According to the method, the part is caused to rotate at least intermittently relative to one or more vibrating surfaces, with at least one of the main faces being exposed to projectiles (6) set into motion by one or more of the vibrating surfaces, treatment taking place progressively on the face(s) so as to impart compression stresses thereto, with a portion only of the part being treated at any one time and with regions of the part preferably being exposed on several occasions to the projectiles, with relative rotation taking place between the exposures.

49 Claims, 6 Drawing Sheets

U.S. PATENT DOCUMENTS

| | | | | |
|---|---|---|---|---|
| 5,730,351 | A * | 3/1998 | Hermann | 228/1.1 |
| 5,829,116 | A | 11/1998 | Vilon | |
| 6,289,705 | B1 | 9/2001 | Duquenne et al. | |
| 6,336,844 | B1 | 1/2002 | Duquenne et al. | |
| 6,490,899 | B1 | 12/2002 | Berthelet et al. | |
| 6,505,489 | B1 | 1/2003 | Berthelet et al. | |
| 6,508,093 | B1 | 1/2003 | Berthelet et al. | |
| 6,517,319 | B1 | 2/2003 | Webster et al. | |
| 6,536,109 | B1 | 3/2003 | Berthelet et al. | |
| 6,837,085 | B1 * | 1/2005 | Berthelet et al. | 72/53 |
| 2003/0115922 | A1 | 6/2003 | Berthelet et al. | |

FOREIGN PATENT DOCUMENTS

| | | | |
|---|---|---|---|
| EP | 1 101 568 | A1 | 5/2001 |
| FR | 2 689 431 | | 10/1993 |
| FR | 2 689 431 | A1 | 10/1993 |
| FR | 2 714 629 | | 7/1995 |
| FR | 2 714 629 | A1 | 7/1995 |
| FR | 2 753 406 | | 3/1998 |
| SU | 1 435 627 | | 11/1988 |
| WO | WO9320247 | * | 10/1993 |
| WO | WO 95/17994 | | 7/1995 |

* cited by examiner

METHOD OF SHOT BLASTING AND A MACHINE FOR IMPLEMENTING SUCH A METHOD

This application claims the benefit of U.S. Provisional Patent Application No. 60/246,095, filed Nov. 7, 2000.

BACKGROUND OF THE INVENTION

1. Field of Invention

The present invention relates to a method of shot peening metal parts, and also to a machine enabling such a method to be implemented.

2. Discussion of Related Art

The technique of shot peening metal parts is well known and consists in imparting compression stresses to the surface of the part by subjecting it to bombardment from projectiles constituted by balls or small shot.

The permanent stress induced on the part by such bombardment has the effect of opposing the appearance and the propagation of cracks, thereby improving the fatigue resistance of the treated part.

It is known that a part can be shot peened by projecting the projectiles towards the surface for treatment by means of a nozzle that is fed with compressed gas.

That technique poses at least two problems when applied to thin walls such as the blades of aeroengine turbines.

Firstly, blades must be treated simultaneously on both opposite faces in order to avoid any deformation that would lead to any perceptible modification of their shape.

Secondly, it is difficult or even impossible to engage the nozzle between the blades when they are close together.

Furthermore, it is difficult with that technique to control the intensity of shot peening with accuracy.

SUMMARY OF THE INVENTION

If a part is not sufficiently shot peened, then it is not given the desired fatigue resistance, whereas if it is excessively shot peened, then the part suffers irreversible damage and its resistance diminishes, and the part may need to be rejected.

Shot peening is made more difficult to control when the wall exposed to the projectiles is thin and easily deformable, as is the case in particular for most aeroengine turbine blades.

The invention seeks to make it possible to shot peen at least one thin wall with precision.

The invention provides a method of shot peening one part comprising at least one thin wall, in which method said part is caused to rotate at least intermittently relative to one or more vibrating surfaces, the or each thin wall defining two main opposite faces, at least one of said main faces being exposed to projectiles such as balls or small shot set into motion by means of one or more of said vibrating surfaces, the treatment being performed progressively on the or each of said faces to impart compression stresses, while treating only a portion of the part at a time and exposing preferably regions of the part several times over to the projectiles with relative rotation between said exposures.

In the present application, a "thin wall" is a wall defining two main opposite faces, with the square root of the area of each face being definitely greater than the mean distance between said two faces, e.g. greater by a factor of at least five, preferably by a factor of more than ten, and preferably by a factor of at least thirty. Mention can be made of various triplets (mean height; mean width; mean thickness) corresponding to various types of aeroengine turbine blade constituting thin walls in the meaning of the present invention, for example: (130; 210; 4), (50; 63; 1.3), (33; 40; 1), (170; 410; 4), where these dimensions are given in millimeters (mm). For these triplets, the ratio of the square root of area over thickness then takes on substantially the following values: 41, 43, 36, and 66, all of which are clearly greater than thirty, and some of which are greater than forty or even greater than sixty. By way of example, the mean thickness of a thin wall can lie in the range 0.1 mm to 10 mm when said wall is constituted by an aeroengine turbine blade.

The method of the invention is advantageously implemented to treat a part comprising a plurality of thin walls that are angularly spaced around a support intended to be driven in rotation, and in particular to treat a one-piece vaned wheel or any other rotor possessing vanes.

The use of one or more vibrating surfaces in the invention makes it possible to avoid using nozzles and makes it possible to shot peen the blades suitably, even when the space between the blades is small.

The vibrating surface(s) is/are advantageously constituted by one or more sonotrodes.

In an embodiment of the invention, protection is provided for an edge of the part to be treated that is liable to be damaged by impacts from the projectiles.

Such protection can be provided by means of at least one protection element fitted to the part or placed on the machine.

The projection element can extend directly in contact with the edge to be protected, or it can be spaced apart therefrom.

In the first circumstance, the protection element can comprise an endpiece fixed removably to the blade.

In the second circumstance, the protection element acts like a deflector and is preferably placed on the projectile path between the vibrating surface or sonotrode and the edge to be protected.

Said edge to be protected can be a sharp edge, e.g. a trailing edge, or it can be some other edge, e.g. the flat present at the end of each blade remote from the support to which the blade is connected.

A part can be treated while it is caused to rotate about an axis of rotation and while exposing each of its thin walls in succession to the projectiles in a treatment chamber through which said thin wall passes.

Rotation can be driven continuously or sequentially.

The method can be implemented by means of one or more treatment chambers.

Advantageously, the part is rotated in such a manner that each of its thin walls performs a plurality of passes through a given treatment chamber or successive passes through different treatment chambers, preferably at least five passes.

When the thin wall presents front and rear faces that are exposed in succession to impacts during rotation of the part, the fact of performing a plurality of revolutions or passes through the treatment chambers enables the shot peening to be made more progressive and makes it possible to use projectiles having lower energy levels.

This reduces the risk of excessively deforming the thin wall(s), while nevertheless ensuring that satisfactory shot peening is obtained after a plurality of revolutions or passes.

Advantageously, thin walls of the part to be treated are used to prevent the projectiles from leaving the treatment chamber(s).

Under such circumstances, the part to be treated can be rotated sequentially, with treatment being interrupted while the part is rotating so as to avoid any projectiles escaping from the treatment chamber(s).

To prevent or to contribute to preventing projectiles from leaving the treatment chamber(s), it is also possible to use one or more jets of compressed gas directed to return the projectiles into the corresponding treatment chamber(s) and also preferably directed in such a manner as to accelerate return of the projectiles towards a vibrating surface.

The use of such jets of compressed gas makes it possible to simplify recovery of the projectiles and, where appropriate, to omit having one or more passive recovery enclosures.

Advantageously, when the vibrating surfaces are defined by sonotrodes and when the part is rotated in sequential manner, power supply to the sonotrodes is interrupted while the part is rotating.

By performing rotation in sequential manner in combination with interrupting power supply to the sonotrodes while the part to be treated is rotating, it is possible to avoid using passive chambers for recovering projectiles, in particular downstream from the treatment chamber.

Sonotrode excitation is advantageously controlled in such a manner as to increase shot peening energy during treatment.

This makes it possible to increase shot peening intensity as the number of passes of the thin wall(s) through the treatment chamber(s) increases.

This thus takes account of the fact that the more a part has been exposed to the impacts of projectiles, the harder its surface becomes and the greater the amount of energy required to give rise to new compression stresses.

The part to be treated can be rotated about an axis of rotation that is vertical or horizontal or otherwise, and in particular that is substantially parallel to one of the edges of the surface to be treated.

An advantage of rotating about a vertical axis is to reduce the effect of the projectiles being entrained by the thin walls to outside the treatment chamber, since the projectiles are less likely to be caught between two thin walls when the surface of the support to which they are connected is substantially vertical and the space between the thin walls in the vicinity of the support is directly open in a downward direction.

Two vibrating surfaces are advantageously located respectively on either side of the path followed by the treated walls, so as to obtain treatment that is more uniform.

The part that includes the thin wall(s) can also be placed in a single enclosure, thus making it possible to avoid problems associated with losing projectiles.

Preferably, the treated part is rotated relative to the vibrating surface(s). In a variant, use is made of one or more vibrating surfaces moved in rotation relative to the thin wall(s), which can then be stationary.

It is possible to take advantage of the shot peening to mark the part by interposing a mask between a face of the part and the projectiles, the mask having apertures that correspond to the marking that is to be made.

Such marking presents the advantage of withstanding any subsequent chemical or heat treatment to which the part might be subjected.

The shot peening can be performed by using a mixture of balls or small shot having different diameters and/or made of different materials, depending on the desired result.

Preferably, both faces of the thin wall are treated simultaneously or almost simultaneously, thus compensating for the effects of projectiles striking one of the faces by means of the effects of the projectiles striking the other face.

It is also possible to treat only one of the two faces of the thin wall at a time.

Under such circumstances, the thin wall is preferably turned over at the end of treating one of its two faces so as to enable its other face to be treated.

In a particular implementation of the invention, the thin wall for treatment is inserted between two moving shutters, each of the shutters being capable of being displaced between a retracted position and a closed position, the shutter situated on the side of the thin wall that is remote from the vibrating surface being in the closed position to close the treatment chamber while the shutter situated between the thin wall and the vibrating surface is in the retracted position to enable the projectiles to bounce on the vibrating surface.

After one face of the thin wall has been treated, the part is turned over together with the shutters. The vibrating surface remains stationary and the shutter which was previously in the closed position is retracted, and vice versa.

In an embodiment of the invention, treatment is applied to a part of annular shape that comprises a plurality of blades constituting thin walls. This part is rotated about an axis which is preferably vertical. The part is preferably treated by means of two sonotrodes having axes that are substantially parallel and preferably vertical. The axes of the two sonotrodes are offset angularly about the axis of rotation of the treated part and the vibrating surfaces defined by these two sonotrodes lie in register respectively with two opposite ends of an inter-blade space.

The part is preferably rotated at a speed which is selected in such a manner that the difference in treatment between a face coming into the treatment zone and a face going out from the treatment zone remains negligible in the treatment as a whole.

The part can be rotated sequentially, with sonotrode excitation being interrupted during rotation of the part.

The invention also provides a machine for shot peening one part comprising at least one thin wall defining two opposite main faces, the square root of the area of each face being greater than the mean distance between the two faces by a factor of at least five, or preferably by a factor of at least ten, said machine comprising excitation members enabling at least one vibrating surface to be set into vibration, and drive members enabling relative rotation to be imparted, at least intermittently, between said part and the vibrating surface(s), the machine further comprising at least one chamber enabling the thin wall(s) to be received for treatment, at least one vibrating surface looking into said chamber, the vibrating surface(s) being suitable for creating a cloud of projectiles in the or each chamber, the machine being arranged to treat a portion only of the part at any one time, such that the treatment is performed progressively on said face(s) in order to introduce compression stresses therein.

Advantageously, the machine comprises elements enabling jets of compressed gas to be generated that are directed onto the projectiles so as to prevent them from leaving the treatment chamber and/or so as to accelerate their return towards the vibrating surface.

Preferably, the machine comprises one or more sonotrodes defining the vibrating surface(s).

Advantageously, the machine includes control means enabling the excitation energy of the sonotrodes to be increased progressively.

For some parts to be treated, in particular a radial collar at the periphery of a part, the machine can include a casing defining a treatment chamber that is capable of being turned relative to a vibrating surface so as to treat the two faces of a thin wall in succession.

Advantageously, the above-mentioned casing houses two moving shutters with the thin wall being inserted between them, each shutter being capable of being displaced between a retracted position enabling the projectiles to bounce on the vibrating surface and a closed position in which it closes the treatment chamber.

The invention also provides a machine for treating a part of annular shape and comprising a plurality of blades, in particular a one-piece vaned wheel that rotates about an axis of rotation that is preferably vertical. Such a machine can have two sonotrodes with substantially parallel axes that are preferably vertical and that are angularly offset about the axis of rotation of the part to be treated in such a manner as to be situated respectively between the bottom edges and the top edges of two blades defining an inter-blade space.

BRIEF DESCRIPTION OF THE DRAWINGS

The invention will be better understood on reading the following detailed description of non-limiting embodiments, and on examining the accompanying drawing, in which.

DETAILED DESCRIPTION OF EXEMPLARY EMBODIMENTS

Figure 1:
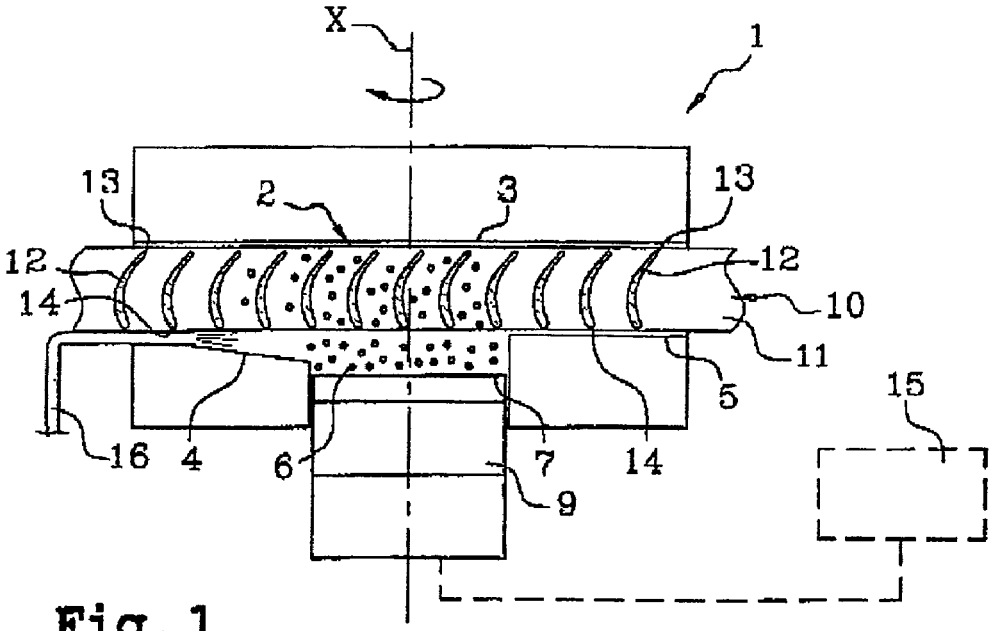
FIG. 1 is a diagrammatic fragmentary side view of a shot peening machine constituting a first embodiment of the invention.

FIG. 1 shows a first embodiment of shot peening apparatus 1 enabling the method of the invention to be implemented.

This apparatus 1 comprises a treatment chamber 2 formed between a top wall 3 and bottom walls 4 and 5, in which chamber a cloud of projectiles 6 is generated by means of a vibrating surface 7 which in this case corresponds to the top end of a sonotrode 9.

The wall 5 is situated upstream from the treatment chamber 2 while the wall 4 is situated downstream.

The part to be treated is constituted in this case by a vaned wheel 10 rotated about a vertical axis X, the wheel comprising a generally annular support 11 provided on its outer periphery with blades 12, e.g. blades that are formed integrally with the support 11.

It would not go beyond the ambit of the present invention for the blades to be made separately and assembled on the support prior to treatment.

The blades 12 are relatively thin compared with their height, as measured in the direction of the axis X, and relative to their radial dimension. The blades 12 constitute thin wall in the meaning of the present invention.

Each blade 12 presents a top edge 13 corresponding to its trailing edge and a bottom edge 14 that is broader, corresponding to its leading edge.

The cloud of projectiles 6 generated in the cavity is sustained by a sonotrode 9 which is controlled by a generator 15.

The projectiles 6 bounce against the walls defining the treatment chamber 2 and on the sonotrode 9 where they acquire kinetic energy.

In the embodiment described, the distance between the bottom walls 4 and 5 situated respectively upstream and downstream from the sonotrode 9 and the top wall 3 is selected in such a manner as to ensure that the clearance left between said walls and the edges 13 or 14 is small enough to prevent projectiles 6 escaping.

The wall 4 situated downstream presents a ramp extending towards the wheel 10 on going away from the sonotrode 9.

A duct 16 opens out at the top of the ramp to blow in compressed air so that projectiles which have been entrained towards the outside of the apparatus by rotation of the wheel 10 are blown back towards the treatment chamber 2, where rotation of the wheel in this case takes place continuously but could in a variant take place discontinuously.

Figure 2:
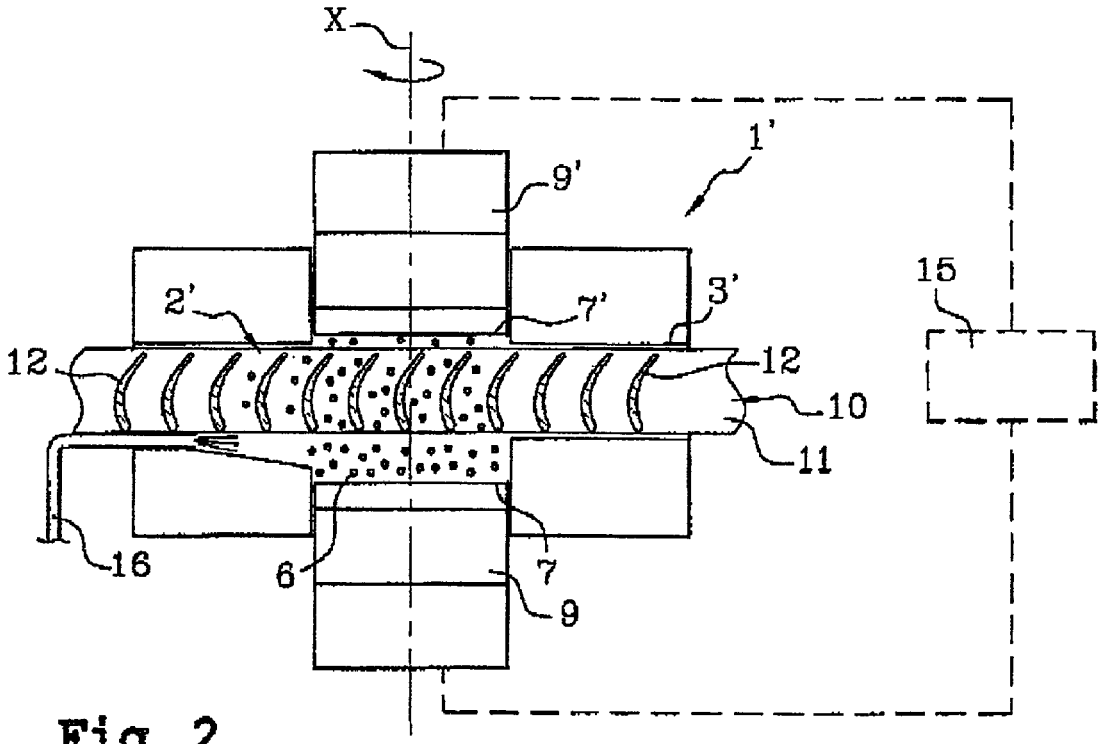
FIG. 2 is a view analogous to FIG. 1 showing a variant embodiment of the invention.

FIG. 2 shows apparatus 1' constituting a variant embodiment of the invention and comprising a treatment chamber 2'.

This apparatus 1' differs from the above-described apparatus 1 mainly by the fact that in addition to the sonotrode 9, it further comprises a second sonotrode 9' defining a vibrating surface 7' parallel to the vibrating surface 7 and placed facing it, above the wheel 10.

The top wall 3 of the preceding embodiment is replaced by a top wall 3' provided with a passage for the sonotrode 9', which sonotrode is connected to the generator 15.

Otherwise, the treatment chamber 2' is identical to the treatment chamber 2.

The presence of the second sonotrode 9' makes it possible for the treatment to be made more uniform and for its duration to be shortened by enabling the projectiles 6 to acquire kinetic energy from the vibrating surface 7' without needing to fall back onto the surface 7.

In the embodiment described, the wheel 10 is rotated about the axis X on a continuous basis, through a number of revolutions that is preferably greater than or equal to five, however rotation could also be performed in sequential manner.

The energy of the projectiles 6 is selected so that a single pass through the treatment chamber 2 or 2' is insufficient to shot peen the blades adequately.

By increasing the number of revolutions, it is possible to accumulate the effects of treatment until a satisfactory level of shot peening is reached, while at no time subjecting the blades to bombardment by projectiles having too high a level of kinetic energy.

The blades are bombarded simultaneously on both of their main faces while they are substantially in the center of the treatment chamber 2 or 2'.

When a blade enters the treatment chamber, only its leading face relative to the direction of rotation of the wheel is bombarded, whereas after it has passed through the treatment chamber, it is bombarded on its trailing face only.

The fact of exposing only one face of each blade bombardment from projectiles on entering the chamber or leaving the chamber is not harmful since the projectiles 6 are given energy at a level which is selected to remain low enough to avoid excessively deforming the blades.

Performing a relatively large number of revolutions presents the advantage whereby a small amount of overlap concerning portions treated at the beginning and at the end of the treatment of the part as a whole does not lead to excessive shot peening because the energy of the projectiles 6 remains relatively low.

In the embodiment described, the amplitude through which the sonotrodes 9 and/or 9' are excited can be increased on each revolution of the wheel 10 so as to take account of the fact that the surface hardness of the treated part increases during treatment, which means that a higher level of energy is required to impart new compression stresses.

Figure 3:
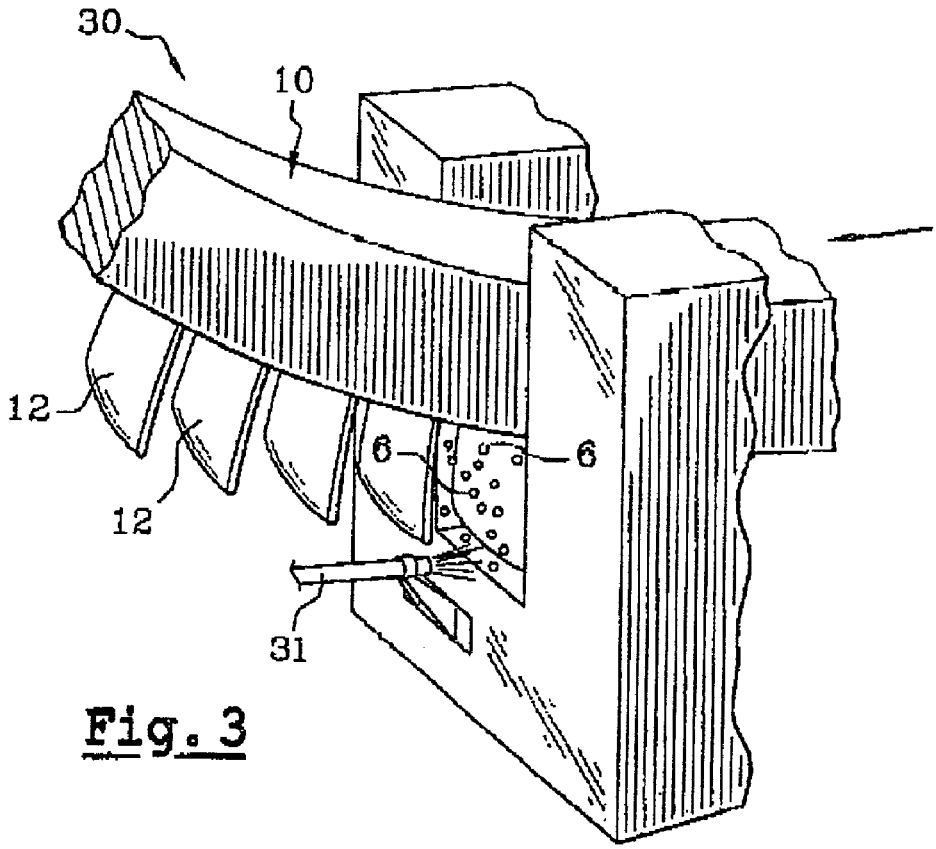
FIG. 3 is a diagrammatic perspective view of a machine constituting a variant embodiment of the invention.

FIG. 3 shows apparatus 30 constituting another embodiment of the invention.

This apparatus 30 differs from the apparatuses 1 and 1' described above mainly by the fact that the part to be treated, in this case a wheel 10 provided with blades 12, is no longer rotated about a vertical axis X, but is rotated about a horizontal axis.

The blades pass through a treatment chamber which is provided with a single vibrating surface on one side or with two vibrating surfaces on two opposite sides.

The openings in the treatment chamber through which the blades enter and leave are preferably of section that corresponds substantially to the section of the blades.

In the embodiment described, a nozzle 31 is used to return projectiles towards the treatment chamber during rotation of the wheel 10, thus making it possible to avoid using passive enclosures for recovering the projectiles.

Figure 4:
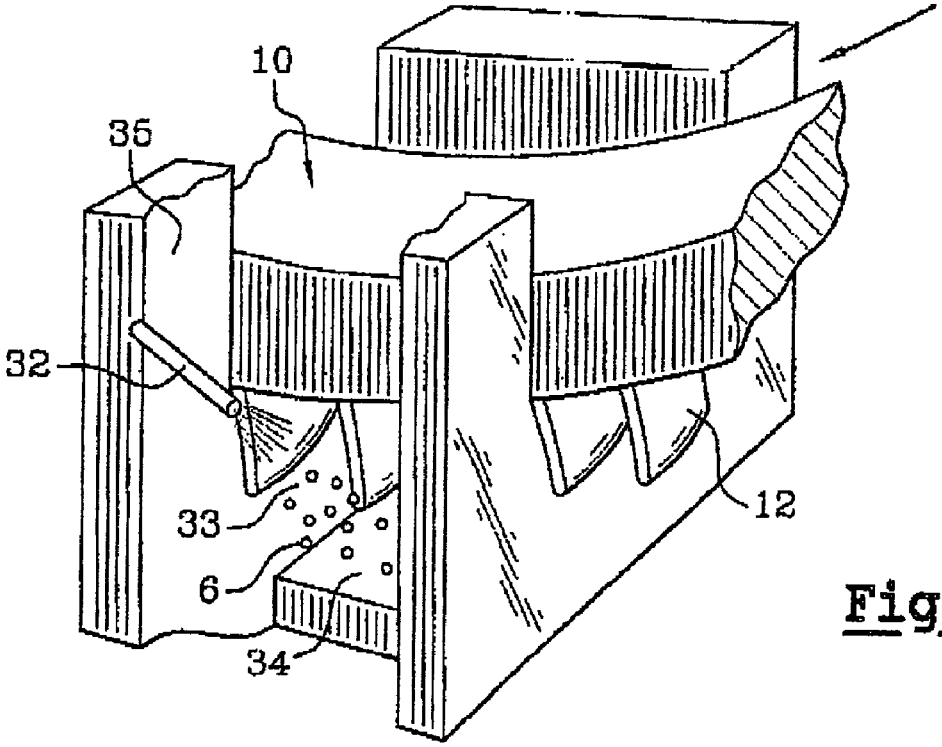
FIG. 4 is a view analogous to FIG. 3 showing another variant embodiment of the invention.

FIG. 4 shows a variant of the FIG. 3 apparatus 30 in which the nozzle 31 is replaced by an internal channel 32 passing through a wall defining the treatment chamber 33, with compressed air exiting this channel 32 serving firstly to prevent the projectiles from leaving the treatment chamber 33 and secondly to accelerate return of the projectiles back to the vibrating surface 34.

In this figure, the front wall 35 of the treatment chamber 33 is shown in part only, so as to reveal the channel 32 and the vibrating surface 34.

Advantageously, advantage is taken of the shot peening to mark a part that is being treated, as described below with reference to FIG. 5.

This figure shows the support 11 partially covered by a mask 40 that includes apertures 41 corresponding to the marking that is to be made.

During shot peening, the region of the support 11 that is covered by the mask 40 is not subjected to the effects of the shot peening, with the exception of the apertures 41.

As a result, when the mask 40 is removed from the support 11, visible marking remains that corresponds to the apertures 41.

By way of example, the marking can correspond to a serial number or a batch number, and such marking turns out to be particularly good at withstanding the conventional treatments to which the part is subjected subsequently.

Figure 5:
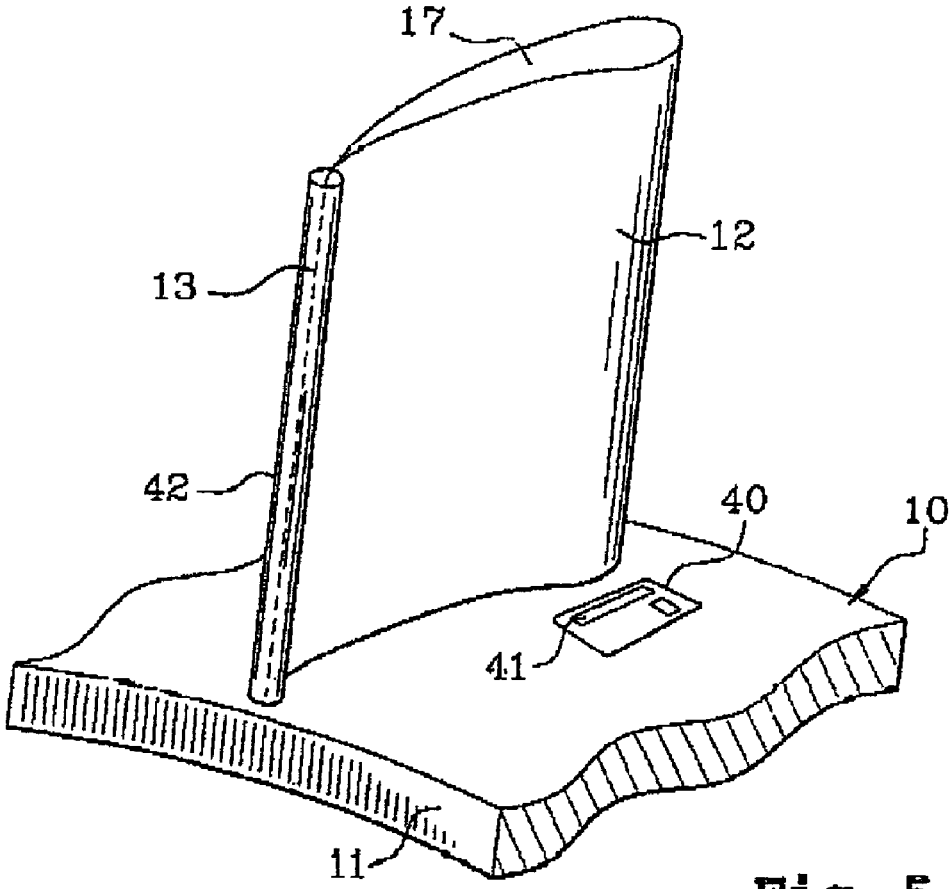
FIG. 5 shows how a part can be marked and also shows an edge protection piece.

The trailing edges 13 of the blades 12 can be protected by means of a protection element in the form of an endpiece 42 which is fitted on each blade during shot peening, as shown in FIG. 5.

Instead of using protection endpieces fitted to the part that is to be treated, it is also possible to place one or more deflectors in front of the edge(s) to be protected, which deflectors are situated at a relatively short distance from the edge(s) to be protected. This prevent projectiles from striking the edge(s) in question head-on.

Each deflector can be placed at a few millimeters, for example, from the edge to be protected, said edge possibly being a sharp edge 13 or a flat 17 (visible in FIG. 5) present at the free end of each blade, at its end remote from the support 11.

Each deflector can be removably secured to the part if the part is rotated continuously, or it can be fixed to the shot peening machine if the part is rotated intermittently.

Figure 5A:
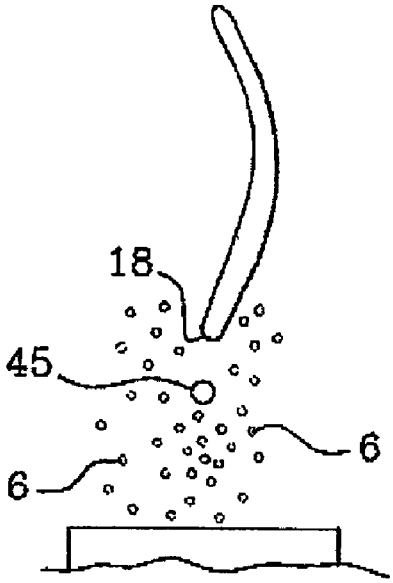
FIG. 5A is a diagrammatic section showing another way of protecting the edge of a blade.

By way of example, FIG. 5A shows a blade whose edge 18 is protected from the impacts of the projectiles 6 by means of a deflector 45.

In the example shown, the deflector 45 is placed on the part of the projectiles between the sonotrode and the edge 18 to be protected. As shown, the deflector 45 can be constituted by a bar which is substantially parallel to the edge to be protected and of a diameter corresponding substantially to the mean thickness of the blade in the vicinity of the edge in question.

When the part is rotated sequentially, the nozzles 16, 31, or the channel 32 as described above can be omitted since it suffices to interrupt sonotrode excitation while the part is being rotated to ensure that the projectiles drop back into the bottom of the treatment chamber and are not entrained out from the chamber by the blades.

Figure 6:
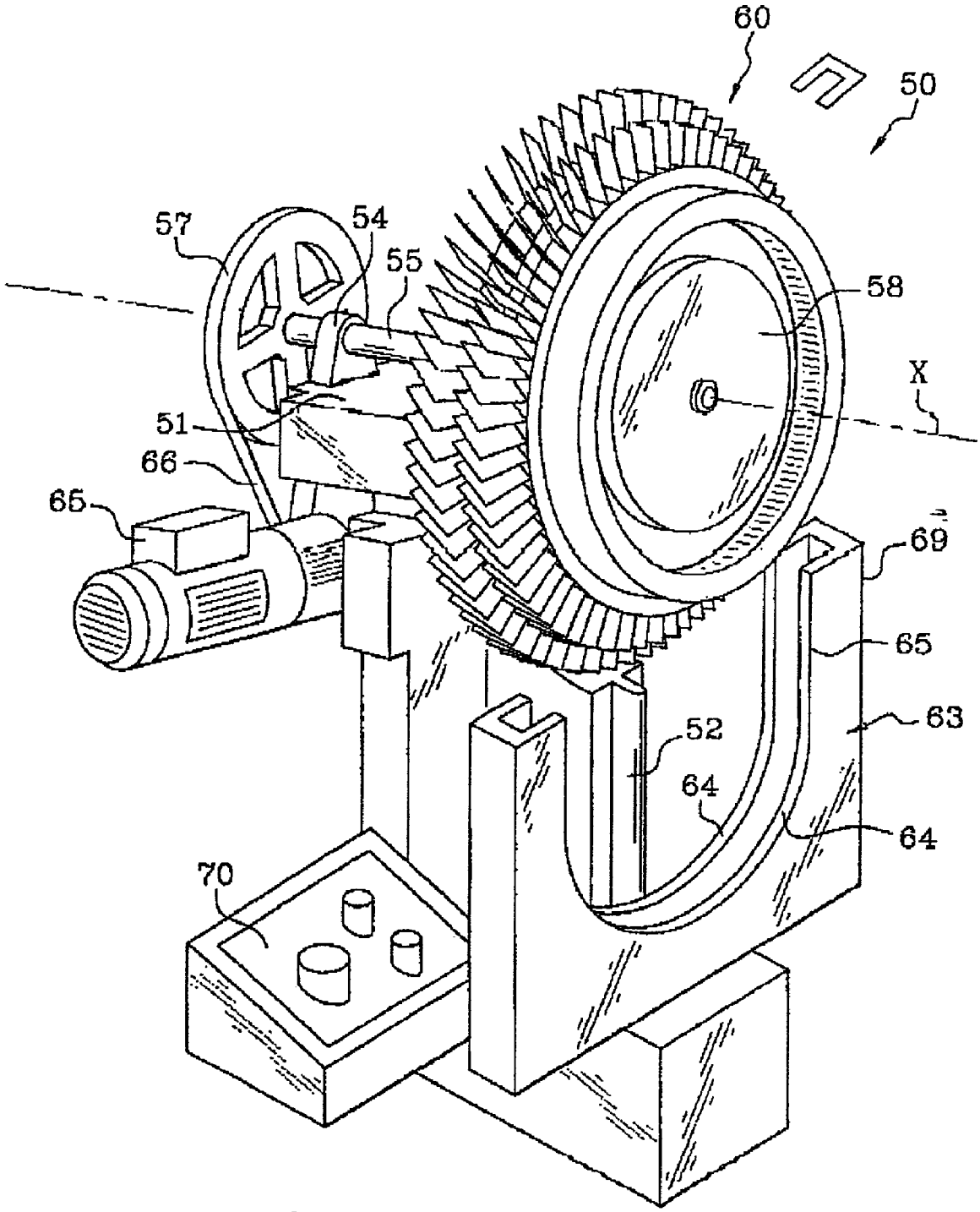
FIG. 6 is a fragmentary diagrammatic perspective view of a shot peening machine constituting another embodiment of the invention.

FIG. 6 shows another example of a shot peening machine 50 enabling the method of the invention to be implemented.

This machine 50 comprises a structure 51 supporting a one-piece vaned wheel 60. The machine 50 also comprises a casing 63 defining a treatment enclosure 65 having a sonotrode (not shown) located in the bottom thereof.

A horizontal shaft 55 rotates in bearings 54 formed at the top of the structure 51.

The shaft 55 is secured at one end to a drive wheel 57 and at its other end to a mandrel 58.

The vaned wheel 60 is mounted on the mandrel 58.

The wheel 57 is rotated by a motor 65 via a belt 66.

The structure 51 has uprights 52 enabling the casing 63 and the associated sonotrode to be moved vertically from a low position which is remote from the wheel 60 to a high position in which the blades can be treated.

The blades then become engaged in succession in the treatment enclosure 65 while the wheel 60 is rotating.

In a direction parallel to the axis of rotation of the wheel 60, the enclosure 65 is defined by walls 64 that match the diameter of the cylindrical surface of the wheel 60 to which the blades are connected.

The side walls of the casing 63 comprise uprights 69 covering a height which is sufficient to prevent projectiles that are present in the bottom of the enclosure from leaving it, with the blades that are received in the uprights 69 opposing upward travel of the projectiles.

The machine 50 also has a control panel 70 enabling rotation of the wheel 60 and operation of the sonotrode to be controlled, inter alia.

Figure 7:
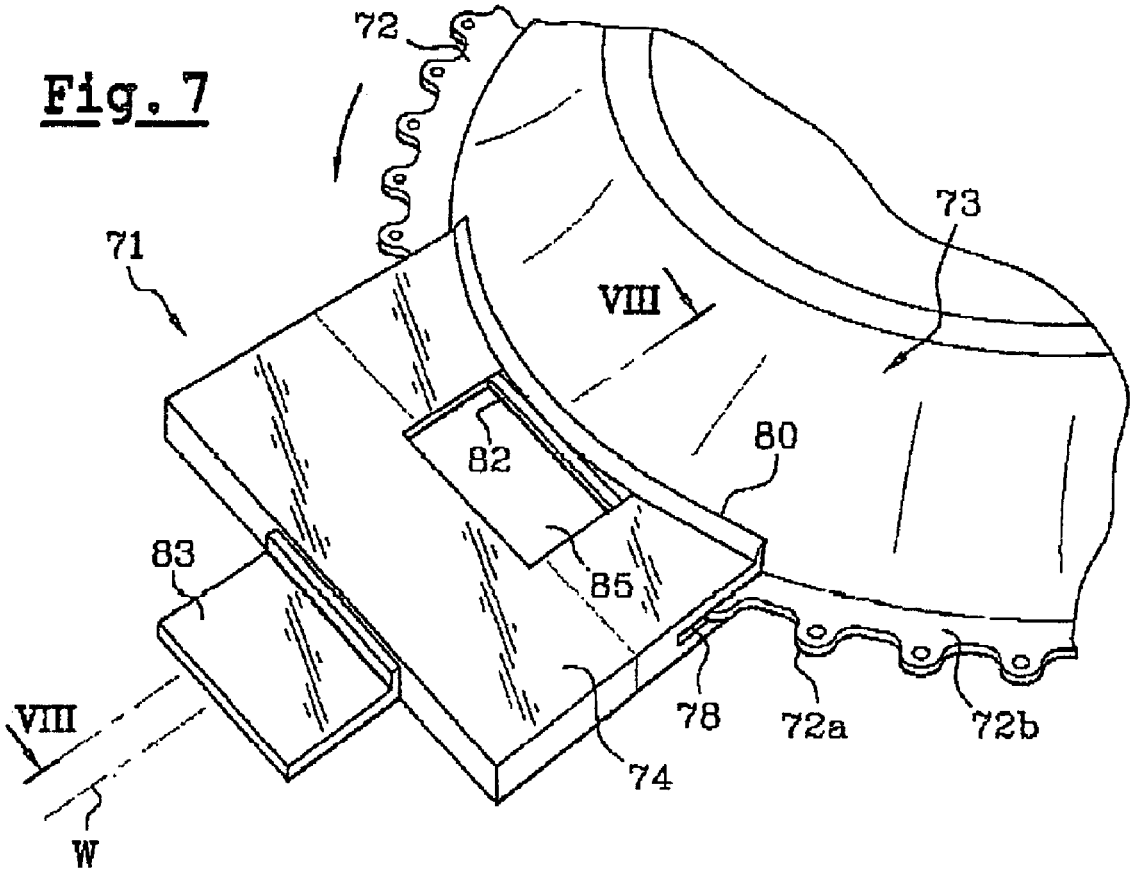
FIG. 7 is a fragmentary diagrammatic perspective view of a shot peening machine constituting another embodiment of the invention, this machine including shutters.

FIG. 7 shows a portion of a shot peening machine 71 for treating two opposite faces 72*a* and 72*b* of an annular collar 72 which projects radially from the base of a generally frustoconical part 73.

The part 73 is rotated about its axis of symmetry which is vertical in this case.

Figure 8:
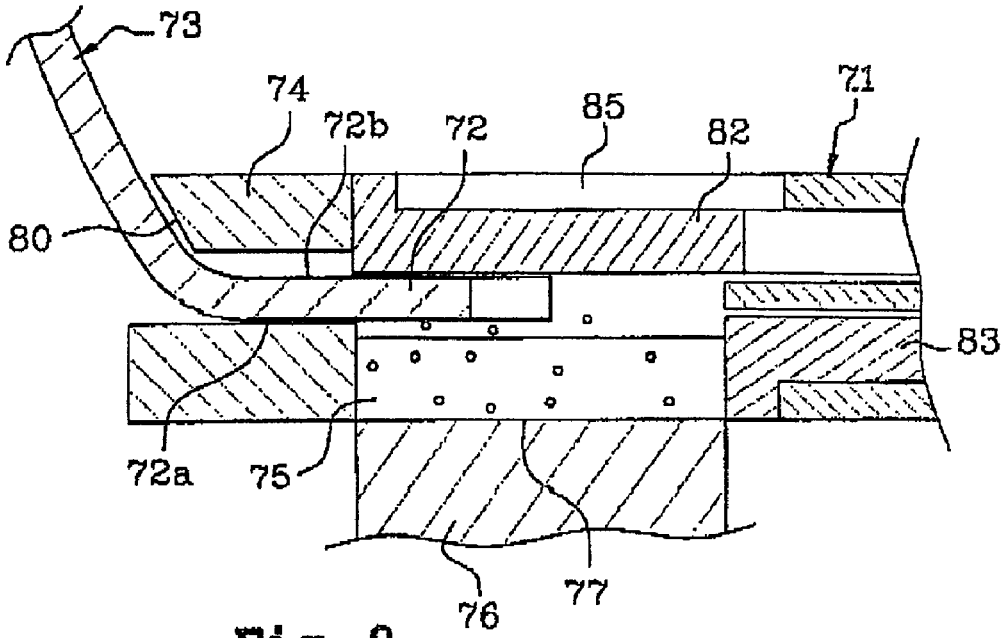
FIG. 8 is a fragmentary diagrammatic view on section line VIII—VIII of FIG. 7, showing the shutters in a first relative configuration.
Figure 9:
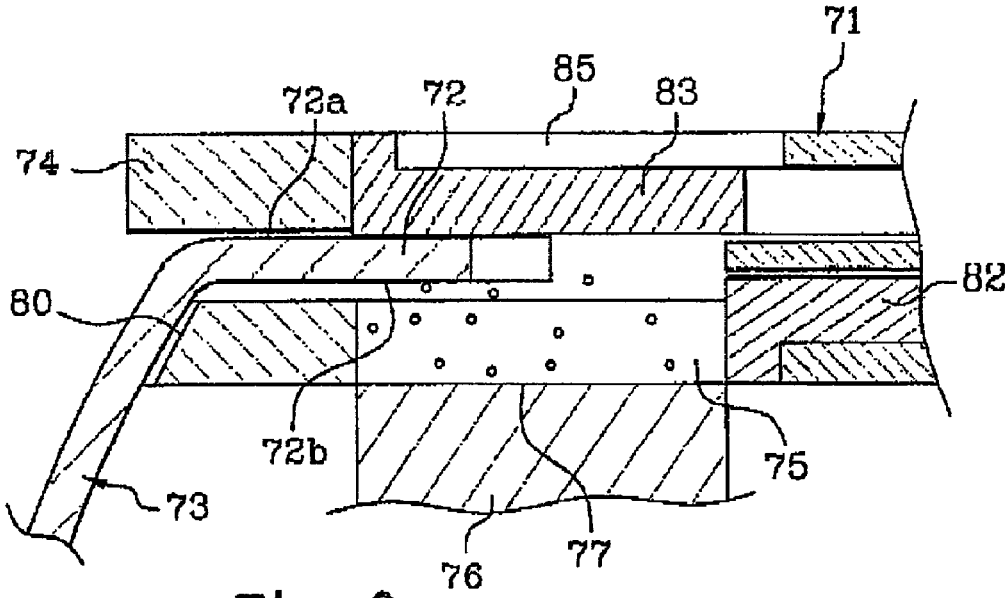
FIG. 9 is a view analogous to FIG. 8, showing the shutters in a second relative configuration.

The shot peening machine 71 comprises a casing 74 defining a treatment chamber 75 which is seen in FIGS. 8 and 9.

The machine 71 has a sonotrode 76 defining a vibrating surface 77 and constituting the bottom of the treatment chamber 75.

The casing 74 has a passage 78 for passing the collar 72, and a side opening of this passage 78 can be seen in FIG. 7.

The casing 74 has a chamfered edge 80 extending along a circular arc over the conical portion of the part 73, and co-operating therewith to leave clearance that is small, smaller than the diameter of the projectiles used.

The casing 74 is supported by a structure (not shown) enabling it to be turned over by turning about an axis perpendicular to the axis of rotation of the part 73 to be treated.

The casing 74 houses two shutters 82 and 83 that can be moved in translation along an axis X.

In the example described, the shutters 82 and 83 include racks (not shown) and a drive mechanism including a pinion meshing with each of the racks, rotation of the pinion causing both shutters to move simultaneously, one towards the part 73 to be treated, while the other moves away therefrom, and vice versa.

The casing 74 has a passage 85 which is a through passage when the shutters are absent.

The sonotrode 76 closes the bottom end of this passage 85.

The top end of the passage 85 is closed by one of the shutters 82 and 83, depending on whether or not the casing 74 has been turned over.

In the configuration shown in FIG. 8, it can be seen that it is the shutter 82 which closes the top portion of the treatment chamber 75, whereas in FIG. 9 it can be seen that it is the shutter 83 which performs this function, the other shutter being in a retracted position enabling the sonotrode 76 to close the bottom of the treatment chamber 75.

When the casing 74 is in the configuration shown in FIG. 8, it is the face 72*a* of the collar 72 which is shot peened.

When the casing 74 is in the configuration of FIG. 9, it is the other face 72*b* which is shot peened.

It is possible to use two sonotrodes and to cause the part to be treated to pass between them, for example by rotating it about an axis of rotation, which axis can be vertical for example, or otherwise.

Figure 10:
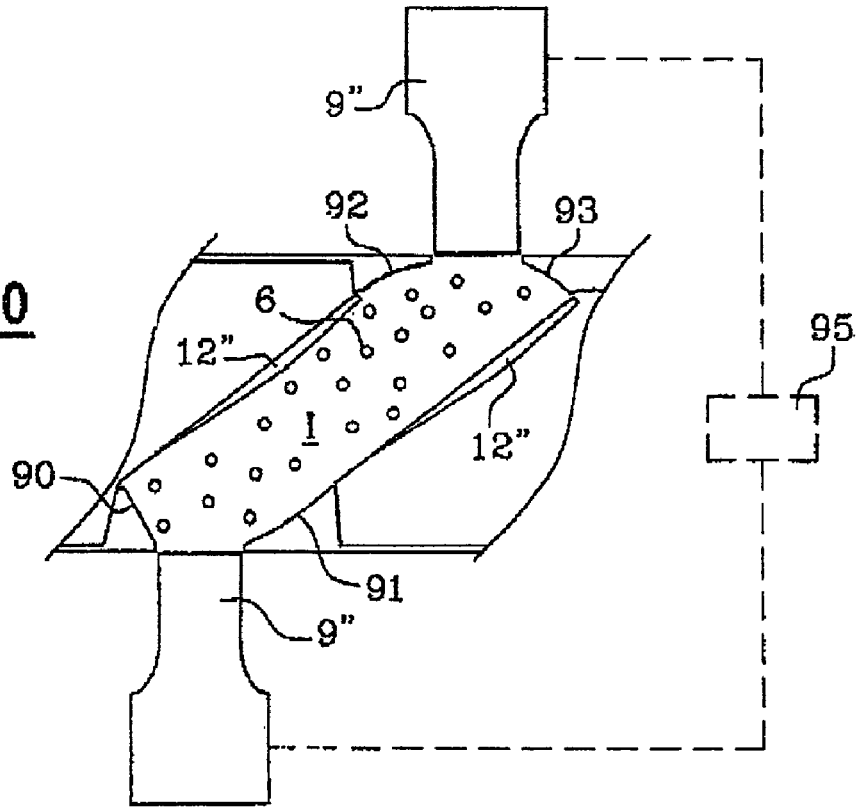
FIG. 10 is a diagrammatic and fragmentary side view of a machine constituting another embodiment of the invention.

FIG. 10 shows an example in which two blades 12" define an inter-blade space I between each other within which a cloud of moving projectiles 6 is generated by means of two sonotrodes 9".

The axes of the sonotrodes 9" are substantially parallel and they are angularly offset about the axis of rotation of the part so as to accommodate the twisting of the blades 12".

The axes of the sonotrodes 9" are thus disposed substantially in the centers of the top and bottom regions of the inter-blade space I, respectively.

Pairs of opposite walls 90 & 91 and 92 & 93 are placed respectively beneath and above the blades 12" so as to prevent the projectiles 6 from escaping and so as to facilitate return of the projectiles towards the vibrating surfaces.

After the facing surfaces of the blades 12" have been treated, the excitation of the sonotrodes is interrupted by control means 95, and the projectiles 6 drop back between the walls 90 and 91.

The part is then turned so as to bring the next inter-blade space I between the sonotrodes 9", and treatment is restarted.

The part can also be treated continuously, in which case it is rotated continuously while the sonotrodes 9" are being excited.

A recovery enclosure (not shown) can serve to recover the projectiles 6 which escape from the inter-blade space I during treatment and means are advantageously provided to feed the inter-blade space with projectiles 6 so as to compensate for the loss of projectiles leaving the treatment zone.

When the thickness of the layer which is put into compression is large relative to the thickness of the blades, the speed of rotation is preferably selected to be high enough to ensure that the difference in treatment between the face entering the treatment zone and the face leaving the treatment zone is negligible for the treatment overall.

During rotation of the part, its axis of rotation is not necessarily vertical. In particular, it could be horizontal or it could be at an acute angle relative to the vertical, for example it could be substantially parallel to the flat that is present at the free end of a blade.

Naturally, the invention is not limited to the embodiments described above.

In particular, it is possible to use apparatuses as described above for treating parts other than aeroengine parts, in particular parts for use on land or at sea.

The sonotrodes can be replaced by other elements capable of producing vibrations enabling projectiles such as balls or small shot to be projected in comparable manner against a part to be treated.

The acoustic elements can be removable and portable so as to be suitable for use in other applications, in particular for maintenance.

The invention claimed is:

1. A method of shot peening at least one part comprising at least one thin wall defining two opposite faces and defining edges, the method comprising:

causing at least one surface to vibrate in a treatment chamber having a fixed structure and a clearance between the structure and the edges; and rotating said part, at least intermittently, through the treatment chamber and relative to said at least one vibrating surface, at least one of said faces being exposed to projectiles set into motion by said at least one vibrating surface.

2. A method according to claim 1, in which at least a region of the part is exposed to the projectiles, the part is rotated at least once, and said at least one region is exposed again to the projectiles.

3. A method according to claim 2, in which the part has a plurality of walls, in which the part is rotated about an axis of rotation, and each wall is exposed successively to the projectiles in the treatment chamber.

4. A method according to claim 3, in which the part is rotated in such a manner that each wall performs a plurality of passes through the treatment chamber.

5. A method according to claim 3, in which the intensity of shot peening is increased with increasing number of passes of the walls through the treatment chamber.

6. A method according to claim 2, in which the part is rotated continuously.

7. A method according to claim 2, in which the part is rotated sequentially.

8. A method according to claim 7, in which the at least one wall is used to prevent projectiles from leaving the treatment chamber, and in which the part is rotated sequentially, with treatment being interrupted while the part is rotating.

9. A method according to claim 1, in which both faces are treated of a plurality of walls that are angularly spaced around a support designed to be rotated.

10. A method according to claim 9, in which said walls are constituted by vanes.

11. A method according to claim 9, wherein the square root of the area of each face is greater than the mean distance between said two faces by a factor of at least five.

12. A method according to claim 9, wherein the square root of the area of each face is greater than the mean distance between said two faces by a factor of at least ten.

13. A method according to claim 1, in which the part has at least one edge liable to be damaged by the impacts of the projectiles, and in which said edge is protected by a protection element fitted on the part or placed in a treatment enclosure.

14. A method according to claim 13, in which the part protection element extends in contact with the edge to be protected.

15. A method according to claim 13, in which the protection element is spaced apart from the edge to be protected.

16. A method according to claim 1, in which at least one jet of compressed gas is used for at least one of preventing the projectiles from leaving the treatment chamber and accelerating recovery thereof.

17. A method according to claim 1, in which said at least one vibrating surface comprises at least one sonotrode.

18. A method according to claim 17, in which excitation of one sonotrode is controlled in such a manner as to increase shot peening energy during treatment.

19. A method according to claim 1, in which the part is rotated about a vertical axis of rotation.

20. A method according to claim 1, in which the part is rotated about a horizontal axis of rotation.

21. A method according to claim 1, in which vibrating surfaces are placed on respective sides of the path followed by the wall.

22. A method according to claim 1, in which the part is marked by interposing a mask between the part and the projectiles, the mask having apertures corresponding to the markings to be made.

23. A method according to claim 1, in which only one of the two faces of a wall is treated at a time.

24. A method according to claim 23, in which, at the end of treating one face, the thin wall is turned over in order to treat the other face.

25. A method according to claim 23, in which the wall is inserted between two moving slides, each slide being capable of being moved between a retracted position and a closed position, the slide situated on the side of the wall that is remote from the vibrating surface being in the closed position to close the treatment chamber and the slide situated between the wall and the vibrating surface being in the retracted position to enable the projectiles to bounce against the vibrating surface.

26. A method according to claim 25, in which, after treating one face of the wall, the part is turned over together with the slides, the vibrating surface remaining stationary; the slide that was previously in the closed position being retracted, and vice versa.

27. A machine for shot peening at least one part comprising at least one thin wall defining two opposite main faces, said machine comprising:

a device enabling at least one vibrating surface to be set into vibration;

a device enabling said part to be rotated at least intermittently relative to said at least one vibrating surface;

at least one chamber having a fixed structure enabling said at least one wall to be received for treatment;

a clearance between the structure and the at least one part; and at least one vibrating surface looking into said chamber, said at least one vibrating surface being suitable for creating a cloud of projectiles in said at least one chamber.

28. A machine according to claim 27, comprising nozzles for ejecting jets of compressed gas against the projectiles for at least one of preventing them from leaving the chamber and accelerating the projectiles' return towards the vibrating surface.

29. A machine according to claim 27, comprising at least one sonotrode defining said at least one vibrating surface.

30. A machine according to claim 29, comprising means enabling the excitation energy of the sonotrode to be increased progressively.

31. A machine according to claim 27, comprising a casing defining a treatment chamber capable of being turned over relative to a vibrating surface in order to treat two faces of a wall in succession.

32. A machine according to claim 31, in which the casing houses two moving slides, between which a wall can be inserted, each slide being capable of being moved between a retracted position enabling the projectiles to bounce against the vibrating surface and a closed position in which it closes the treatment chamber.

33. A machine according to claim 27, comprising at least two sonotrodes having axes that are substantially parallel and that are offset angularly around the axis of rotation of the treated part, the vibrating surfaces defined by the sonotrodes being situated respectively at two ends of an inter-blade space.

34. A method of shot peening a part comprising a plurality of vanes distributed angularly around a support that is designed to be rotated, each vane having two opposite faces, comprising:

causing at least one surface comprising at least one sonotrode to vibrate in a treatment chamber having a clearance between the treatment chamber and the vanes; and rotating said part, at least intermittently, relative to said at least one vibrating surface, at least one of the faces of at least one vane being exposed to projectiles set into motion by said at least one vibrating surface, the exposure of the part to projectiles being applied to only one portion of the part at a time, and regions of the part being exposed several times to the projectiles, with relative rotation taking place between said exposures.

35. A machine for shot peening a part comprising a plurality of vanes distributed angularly around a support that is designed to be rotated, each vane having two opposite faces, said machine comprising:

at least one treatment chamber suitable for receiving at least one vane for treatment;

a clearance between the vanes and the treatment chamber at least one vibrating surface looking into said chamber;

a device enabling said at least one vibrating surface to be set into vibration; and a device enabling said part to be rotated at least intermittently relative to said at least one vibrating surface, said at least one vibrating surface being suitable for creating a cloud of projectiles in said at least one treatment chamber.

36. An apparatus for shot peening at least one part comprising at least one thin wall defining two opposite faces, comprising:

means for causing at least one surface to vibrate in a treatment chamber comprising a fixed structure;

a clearance between the wall and the fixed structure; and means for rotating said part at least intermittently, relative to said at least one vibrating surface, at least one of said faces being exposed to projectiles set into motion by means of said at least one vibrating surface.

37. An apparatus for shot peening a part comprising a plurality of vanes distributed angularly around a support that is designed to be rotated, each vane having two opposite faces, comprising:

means for causing at least one surface comprising at least one sonotrode to vibrate in a treatment chamber comprising a fixed structure;

a clearance between each vane and the fixed structure; and means for rotating said part, at least intermittently, relative to said at least one vibrating surface, at least one of the faces of at least one vane being exposed to projectiles set into motion by means of said at least one vibrating surface, the exposure of the part to projectiles being applied to only one portion of the part at a time, and regions of the part being exposed several times to the projectiles, with relative rotation taking place between said exposures.

38. An apparatus for shot peening at least one part comprising a plurality of walls each defining two opposite faces, comprising:

means for causing said part to rotate at least intermittently relative to at least one vibrating surface set into vibration by a sonotrode, said faces of at least one of said walls being exposed to projectiles set into motion by means of said at least one vibrating surface;

means for exposing each wall in succession to the projectiles in at least one treatment chamber designed to allow the walls to pass through during their treatment; and means for controlling an excitation of the sonotrode so as to increase the intensity of shot peening as the number of passes of the walls through the treatment chamber increases.

39. A method of shot peening at least one part comprising at least one thin wall defining two opposite faces, comprising:

causing at least one surface to vibrate along a vibration axis; and rotating said part at least intermittently relative to said at least one vibrating surface and around an axis of rotation, at least one of said faces being exposed to projectiles set into motion by said at least one vibrating surface, a vibration axis being parallel to the rotation axis.

40. A method of shot peening at least one part having at least one edge liable to be damaged by impacts of projectiles, the method comprising:

causing at least one surface to vibrate;

rotating said part, at least intermittently, relative to said at least one vibrating surface, at least one face of the part being exposed to the projectiles set into motion by said at least one vibrating surface; and protecting the at least one edge by a protection element fitted on the part in contact with the at least one edge.

41. A method of shot peening at least one part having at least one edge liable to be damaged by impacts of projectiles, the method comprising:

causing at least one surface to vibrate;

rotating said part, at least intermittently, relative to said at least one vibrating surface, at least one face of the part being exposed to the projectiles set into motion by said at least one vibrating surface; and protecting the at least one edge by a protection element fitted on the part and spaced apart from the at least one edge to be protected.

42. A method of shot peening at least one part, comprising:

causing at least one surface to vibrate in a treatment chamber;

rotating said part, at least intermittently, relative to said at least one vibrating surface, at least one face of the part being exposed to projectiles set into motion by said at least one vibrating surface; and preventing the projectiles from leaving the treatment chamber by projecting at least one jet of compressed gas against the projectiles.

43. A method of shot peening at least one part, comprising:

causing at least one surface to vibrate; and rotating said part, at least intermittently, relative to said at least one vibrating surface, at least one face of the part being exposed to projectiles set into motion by said at least one vibrating surface, said at least one vibrating surface comprising at least one sonotrode, wherein the excitation of one sonotrode is controlled in such a manner as to increase shot peening energy during treatment.

44. A method of shot peening at least one part comprising at least one wall defining two opposite faces, comprising:

causing at least two surfaces to vibrate; and rotating said part, at least intermittently, relative to said at least two vibrating surfaces, at least one of said faces being exposed to projectiles set into motion by the at least one vibrating surface, wherein the vibrating surfaces are placed on respective sides of the path followed by the treated wall.

45. A method of shot peening at least one part comprising at least one wall defining two opposite faces, comprising:

causing at least one surface to vibrate;

rotating said part, at least intermittently, relative to said at least one vibrating surface, at least one of said faces being exposed to projectiles set into motion by the at least one vibrating surface; and marking the part by interposing a mask between the part and the projectiles, the mask having apertures corresponding to markings to be made.

46. A method of shot peening at least one part comprising at least one wall defining two opposite faces, comprising:

causing at least one surface to vibrate; and rotating said part, at least intermittently, relative to said at least one vibrating surface, at least one of said faces being exposed to projectiles set into motion by the at least one vibrating surface, wherein only one of the two faces of the wall is treated at a time, and wherein the wall is inserted between two moving slides, each slide being capable of being moved between a retracted position and a closed position, the slide situated on the side of the wall that is remote from the vibrating surface being in the closed position to close a treatment chamber and the slide situated between the wall and the vibrating surface being in the retracted position to enable the projectiles to bounce against the vibrating surface.

47. A machine for shot peening at least one part, comprising:

at least one vibrating surface;

a drive to rotate said part at least intermittently relative to said at least one vibrating surface;

at least one chamber enabling said at least one wall of said part to be received for treatment; and nozzles to direct jets of compressed gas against projectiles so as to prevent them from leaving the chamber.

48. A machine for shot peening at least one part, comprising:

at least one vibrating surface;

a drive to rotate at least intermittently said part relative to said at least one vibrating surface; and a casing defining a treatment chamber capable of being turned over relative to vibrating surface in order to treat two faces of a wall of said part in succession, wherein the casing houses two moving slides, between which the wall can be inserted, each slide being capable of being moved between a retracted position enabling projectiles to bounce against the vibrating surface and a closed position in which the slide closes the treatment chamber.

49. A machine for shot peening at least one part, comprising:

a drive to rotate said at least one part at least intermittently around an axis of rotation;

at least a first and second sonotrodes to cause at least a first and second surfaces to vibrate, the first and second sonotrodes having axes that are substantially parallel and that are offset angularly around the axis of rotation of the part; and projectiles for shot peening the at least one part by a movement induced by bouncing on at least one of the first and second surfaces.

* * * * *

UNITED STATES PATENT AND TRADEMARK OFFICE

CERTIFICATE OF CORRECTION

PATENT NO. : 7,028,378 B2
APPLICATION NO. : 09/972863
DATED : April 18, 2006
INVENTOR(S) : Patrick Cheppe and Jean-Michel Duchazeaubeneix It is certified that error appears in the above-identified patent and that said Letters Patent is hereby corrected as shown below:

(54) Please replace the title and at column 1 lines 1-3 "METHOD OF SHOT BLASTING AND A MACHINE FOR IMPLEMENTING SUCH A METHOD" to --METHOD OF SHOT PEENING AND A MACHINE FOR IMPLEMENTING SUCH A METHOD--.

Signed and Sealed this

Twenty-second Day of August, 2006

JON W. DUDAS
*Director of the United States Patent and Trademark Office*